US006347717B1

(12) United States Patent
Eberle

(10) Patent No.: US 6,347,717 B1
(45) **Date of Patent: *Feb. 19, 2002**

(54) HOT FILL PLASTIC CONTAINER HAVING SPACED APART ARCHED RIBS

(75) Inventor: Theodore F. Eberle, Chicago, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/572,490

(22) Filed: May 15, 2000

Related U.S. Application Data

(63) Continuation of application No. 09/071,752, filed on May 1, 1998, now Pat. No. 6,062,409, which is a continuation-in-part of application No. 29/080,237, filed on Dec. 5, 1997, now abandoned.

(51) Int. Cl.[7] ..... B65D 1/02; B65D 1/42; B65D 23/08

(52) U.S. Cl. ..... 215/381; 215/382; 220/675

(58) Field of Search ..... 215/381–383; 220/675

(56) References Cited

U.S. PATENT DOCUMENTS

| | | | | |
|---|---|---|---|---|
| D57,979 | S | 5/1921 | King | D9/538 |
| D204,325 | S | 4/1966 | Myers et al. | D9/571 |
| 4,816,273 | A | 3/1989 | Smith et al. | 215/381 X |

(List continued on next page.)

FOREIGN PATENT DOCUMENTS

| | | |
|---|---|---|
| EP | 0 703 152 A1 | 3/1996 |
| WO | WO 97/32791 | 9/1997 |
| WO | WO 97/34808 | 9/1997 |
| WO | WO 98/05566 | 2/1998 |

*Primary Examiner*—Stephen P. Garbe
(74) *Attorney, Agent, or Firm*—Woodcock Washburn LLP

(57) ABSTRACT

The present invention provides an improved blow molded plastic container that is adapted for hot fill applications. The hot fill container of the present invention comprises a plurality of vacuum panels, having substantially arched upper and lower ends, as opposed to the substantially straight upper and lower ends as described in the related art. The hot fill container of the invention further comprises novel and unique vacuum panel reinforcement means. The vacuum panel reinforcement means are a series of arched ribs. One series of ribs is placed in the label mounting area above the vacuum panels and one series of ribs is placed in the label mounting area below the vacuum panels. The ribs extend noncontinuously around the circumference of the body of the plastic container and are spaced apart from each other by a land area. Each rib is also spaced apart from the vacuum panel and is centered over a land area between vacuum panels. The hot fill bottle of the invention is particularly adapted to minimize the stress placed on the corners of vacuum panels and to resist flexing when the container is filled with a hot liquid.

20 Claims, 4 Drawing Sheets

U.S. PATENT DOCUMENTS

| | | | | |
|---|---|---|---|---|
| D307,551 | S | 5/1990 | Platte, Sr. | D9/378 |
| D307,721 | S | 5/1990 | Barth | D9/455 |
| D313,750 | S | 1/1991 | York et al. | D9/394 |
| D316,964 | S | 5/1991 | York | D9/349 |
| D316,966 | S | 5/1991 | York | D9/390 |
| D316,967 | S | 5/1991 | York | D9/390 |
| D316,968 | S | 5/1991 | York | D9/392 |
| D318,799 | S | 8/1991 | York | D9/390 |
| D321,136 | S | 10/1991 | York | D9/434 |
| D321,830 | S | 11/1991 | York et al. | D9/434 |
| 5,101,990 | A | 4/1992 | Krishnakumar | 215/1 C |
| D327,845 | S | 7/1992 | Behm et al. | D9/434 |
| 5,141,120 | A | 8/1992 | Brown et al. | 215/1 |
| 5,141,121 | A | 8/1992 | Brown et al. | 215/100 A |
| 5,148,930 | A | 9/1992 | Ota et al. | 220/675 X |
| D330,330 | S | 10/1992 | Behm et al. | D9/434 |
| 5,165,558 | A | 11/1992 | Cargile | 215/100 R |
| 5,188,249 | A | 2/1993 | Cargile | 215/31 |
| 5,238,129 | A | 8/1993 | Ota | 215/381 |
| D344,457 | S | 2/1994 | Prevot et al. | D9/537 |
| 5,337,909 | A | 8/1994 | Vailliencourt | 215/381 |
| 5,341,946 | A | 8/1994 | Vailliencourt et al. | 220/675 X |
| D352,238 | S | 11/1994 | Vailliencourt et al. | D9/434 |
| D352,245 | S | 11/1994 | Krishnakumar et al. | D9/538 |
| 5,392,937 | A | 2/1995 | Prevot et al. | 215/1 C |
| 5,407,086 | A | 4/1995 | Ota et al. | 215/383 |
| D358,766 | S | 5/1995 | Vailliencourt et al. | D9/434 |
| 5,431,291 | A | 7/1995 | LaBombarbe, Jr. | 215/44 |
| 5,460,287 | A | 10/1995 | Cargile et al. | 220/306 |
| D364,565 | S | 11/1995 | Vailliencourt et al. | D9/434 |
| 5,472,105 | A | 12/1995 | Krishnakumar et al. | 215/384 |
| D366,416 | S | 1/1996 | Semersky | D9/434 |
| D366,417 | S | 1/1996 | Semersky | D9/434 |
| 5,484,072 | A | 1/1996 | Beck et al. | 215/375 |
| D366,831 | S | 2/1996 | Semersky et al. | D9/434 |
| 5,503,283 | A | 4/1996 | Semersky | 215/375 |
| 5,598,941 | A | 2/1997 | Semersky et al. | 215/384 |
| 5,622,579 | A | 4/1997 | Tobias | 156/73.1 |
| 5,678,711 | A | 10/1997 | Tobias | 215/42 |
| 5,704,503 | A | 1/1998 | Krishnakumar et al. | 220/675 X |
| 5,704,506 | A | 1/1998 | Tobias et al. | 215/398 |
| D391,168 | S | 2/1998 | Ogg | D9/538 |
| 5,714,109 | A | 2/1998 | Diller | 264/454 |
| D393,802 | S | 4/1998 | Collette et al. | D9/538 X |
| 5,762,221 | A | 6/1998 | Tobias et al. | 215/381 |
| D397,614 | S | 9/1998 | Krishnakumar et al. | D9/538 X |
| 6,062,409 | A * | 5/2000 | Eberle | 215/381 |

* cited by examiner

HOT FILL PLASTIC CONTAINER HAVING SPACED APART ARCHED RIBS

CROSS REFERENCE TO RELATED APPLICATIONS

This application is a continuation of prior application Ser. No. 09/071,752, filed May 1, 1998, now U.S. Pat. No. 6,062,409, which is a continuation-in-part of prior application Ser. No. 29/080,237, filed Dec. 5, 1997, now abandoned.

BACKGROUND OF THE INVENTION

1. Field of the Invention

This invention relates to hot fill plastic containers, and more particularly, to such containers having an improved label mount area in the body portion.

2. Description of the Related Technology

The use of blow molded plastic containers for packaging "hot fill" beverages is well known. However, a container that is used for hot fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot fill liquid is introduced into the container. As the liquid cools, the liquid shrinks in volume which, in turn, produces a negative pressure or vacuum in the container. The container must be able to withstand such changes in pressure without failure.

As described in U.S. Pat. No. 5,337,909, hot fill containers typically comprise substantially rectangular vacuum panels that are designed to collapse inwardly after the container has been filled with hot liquid. However, the inward flexing of the panels caused by the hot fill vacuum creates high stress points at the top and bottom edges of the pressure panels, especially at the upper and lower corners of the panels. These stress points weaken the portions of the sidewall near the edges of the panels, allowing the sidewall to collapse inwardly during handling of the container or when containers are stacked together.

The hot-fill container disclosed in U.S. Pat. No. 5,337,909 has annular reinforcement ribs that extend continuously around the circumference of the container sidewall. It is stated that the reinforcement ribs support the vacuum panels at their upper and lower edges, holding the edges fixed, while permitting the center portions of the vacuum panels to flex inwardly while the bottle is being filled and to resist deformation of the vacuum panels subsequent to inward flexing of the vacuum panels due to filling and sealing of the container. FIGS. 5 and 6 depict an embodiment wherein the reinforcement ribs merge with the edges of the vacuum panels at the edge of the label upper and lower mounting panels.

Another hot-fill container having reinforcement ribs is disclosed in WO 97/34808. The container described in 97/34808 comprises a label mounting area having an upper and lower series of peripherally spaced, short, horizontal ribs separated endwise by label mount areas. It is stated that each upper and lower rib is located within the label mount section and is centered above or below, respectively, one of the lands. The container further comprises several rectangular vacuum panels that also experience high stress point at the corners of the collapse panels. It is further stated that the ribs stiffen the container adjacent lower corners 46 of the collapse panels.

It is an object of the present invention to provide a hot-filled, blow molded, plastic container which provides improved vacuum panels that minimize the stress points on the corners of the vacuum panels, by substantially removing these stress points, and thereby provide lower failure rates.

It is another object of the invention to provide a hot fill bottle having vacuum panels with sufficient reinforcement and support means.

It is another object of the invention to provide a hot fill bottle that maximizes the areas of contact between the label and the label mounting areas.

SUMMARY OF THE INVENTION

The present invention provides an improved blow molded plastic container that is adapted for hot fill applications. In hot fill applications, the plastic container is filled with a liquid that is above room temperature and then sealed so that the cooling of the liquid creates a reduced volume in the container. The preferred hot fill container of the present invention comprises a plurality of vacuum panels, having substantially curved upper and lower ends, as opposed to the substantially straight upper and lower ends as described in the related art. The preferred hot fill container of the invention further comprises novel and unique vacuum panel reinforcement means. The vacuum panel reinforcement means are a plurality of curved ribs. Preferably, the ribs are substantially identical to each other, and at least one series of ribs is placed in the label mounting area above the vacuum panels and/or at least one series of ribs is placed in the label mounting area below the vacuum panels. The ribs extend noncontinuously around the circumference of the body of the plastic container and are spaced apart from each other by a land area. Each rib is also spaced apart from the vacuum panel and is centered over a land area between vacuum panels. Preferably, each rib is substantially arched.

The hot fill bottle of the invention is particularly adapted to minimize the stress placed on the corners of vacuum panels and to resist flexing when the container is filled with a hot liquid. The substantially straight upper and lower ends of the vacuum panels of the related art create high stress at the corners of the vacuum panels that frequently result in failure of the container during storage or use. The novel structure of the container of the invention, including the unique structure of the vacuum panels combined with novel reinforcement means, reduces the stress placed on the corners of the vacuum panels when the panels are flexed inwardly during filling and cooling and provide additional support to the panels to resist flexing and deformation due to sealing of the container. The arched ribs of the container also provide additional support to the vacuum panels at their upper and lower edges. In addition, the novel design of the hot fill container also provides for additional areas on the label mounting area for receiving an adhesive or for contact with a shrink wrap label, thereby improving the process for applying a label to the container.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

A thin-walled container in accordance with the present invention is intended to be filled with a liquid at a temperature above room temperature. According to the invention, a container may be formed from a plastic material such as polyethylene terephthlate (PET) or polyester. Preferably, the container is blow molded. The container can be filled by automated, high speed, hot-fill equipment known in the art.

Figure 1:
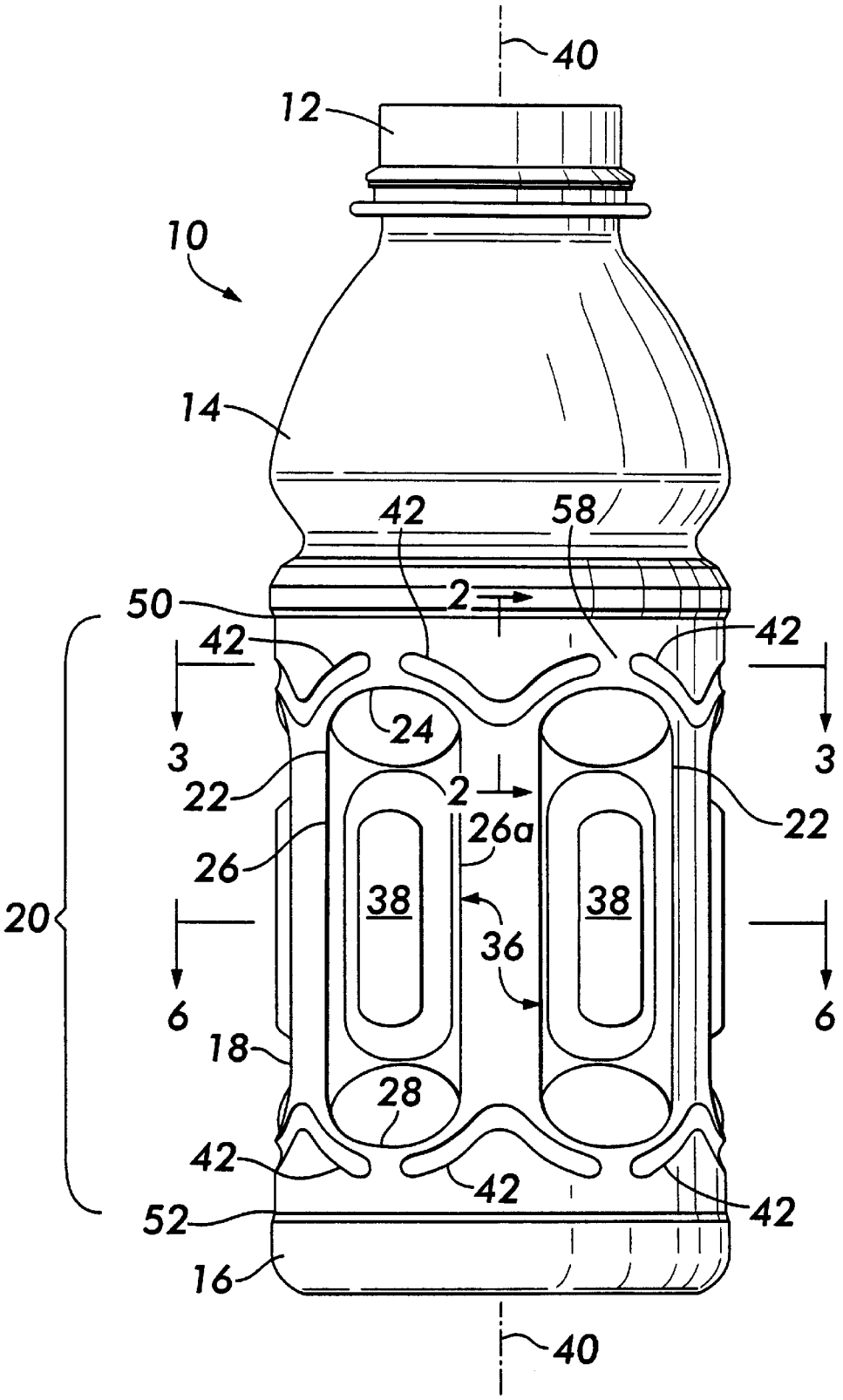
FIG. 1 is an elevational view of a container having ribs in accordance with the present invention.

Referring now to the drawings, a preferred embodiment of the container of this invention is indicated generally at 10, as shown in FIG. 1, as generally having many of the well known features of hot-fill bottles. The container (10) has a longitudinal axis (40) when the container is standing upright on its base. The container comprises a closable neck (12) for filling and dispensing fluid. Neck (12) also is sealable. The preferred container further comprises base (16) and at least one shoulder (14) located below neck (12) and above base (16). The preferred container of the present invention also has a body (18) of generally circular cross section that connects shoulder (14) and base (16). The body of the preferred container has a label mounting area (20) that is located between upper label bumper (50) and lower label bumper (52). A label can be applied to the label mounting area using methods that are well known to those skilled in the art, including shrink wrap labeling and adhesive methods. As applied, the label extends around the entire body of the container.

The label mount area of the preferred container comprises a plurality of identical, space-apart vertically elongate vacuum panels (22). The vacuum panels permit the bottle to flex inwardly upon filling with the hot fluid, sealing, and subsequent cooling. The number of vacuum panels is variable, although six panels generally are preferred. Preferably, the vacuum panel is substantially ellipsoidal in shape and has a curved upper edge (24), a curved lower edge (28), substantially straight side edges (26) and **(26*a*), and a panel portion (38) that is intermediate the upper and lower edges. Preferably, the upper and lower edges of the vacuum panels are substantially arched. Adjacent vacuum panels are spaced apart from each other by land area (36). The upper edges of the vacuum panels are spaced apart from the upper label bumper (50) (or the upper label mount area) and the lower edges of the vacuum panels are spaced apart from the lower label bumper (52)** (or the lower label mount area). The vacuum panels are covered by the label once it is applied to the container.

The label mount area of the preferred container further comprises reinforcement means for providing support to adjacent vacuum panels after the container is filled with hot fluid. The reinforcement means include a plurality of curved ribs, and preferably, at least one series of upper and/or lower arched ribs (42). Preferably, a plurality, or more preferably one series of ribs, is located in the upper label mount area between the upper edge of the vacuum panels and the upper label bumper. The remainder of the ribs, or another series of ribs, is located in the lower label mount area between the lower edge of the vacuum panels and the lower label bumper. Each rib extends longitudinally around the circumference of the body of the container and is spaced apart from an adjacent rib by land area (58). The ribs are also spaced apart from the upper and lower edges of the vacuum panels, respectively, and are placed proximate to land area (36). Preferably, the ribs are centered so that the peak of the arched rib is centered over land area (36). The ribs of each series are noncontinuous, i.e., they do not touch each other. Nor do they form a ring around the body of the container.

As shown in FIG. 1, in a preferred embodiment there are six vacuum panels, six land areas (36), six upper arched ribs, and six lower arched ribs. Of course, the number of arched ribs may vary, although it is preferred that the length and configuration of each rib is substantially identically to that of the remaining ribs of the series.

Figure 2:
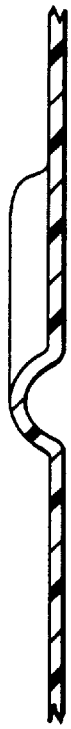
FIG. 2 is a cross section taken along line 2—2 of FIG. 1.
Figure 3:
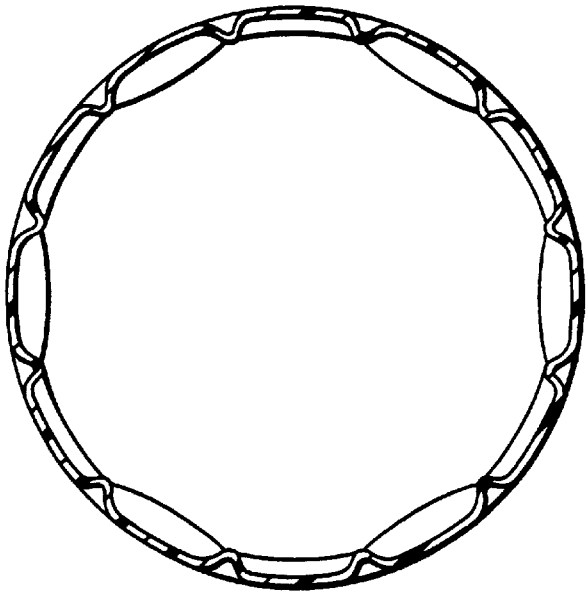
FIG. 3 is a cross section taken along line 3—3 of FIG. 1.

As shown in FIG. 2, the ribs preferably have a generally semi-circular cross section and may be directed radially inward toward longitudinal axis (40) or outward (away from longitudinal axis (40)), with radially inward being preferred. In a preferred embodiment and as depicted in FIG. 1, the contour of at least a portion of the rib is substantially similar to at least a portion of the contour of the adjacent vacuum panels. Therefore, the contour of each series of ribs appears to be generally scalloped.

Figure 4:
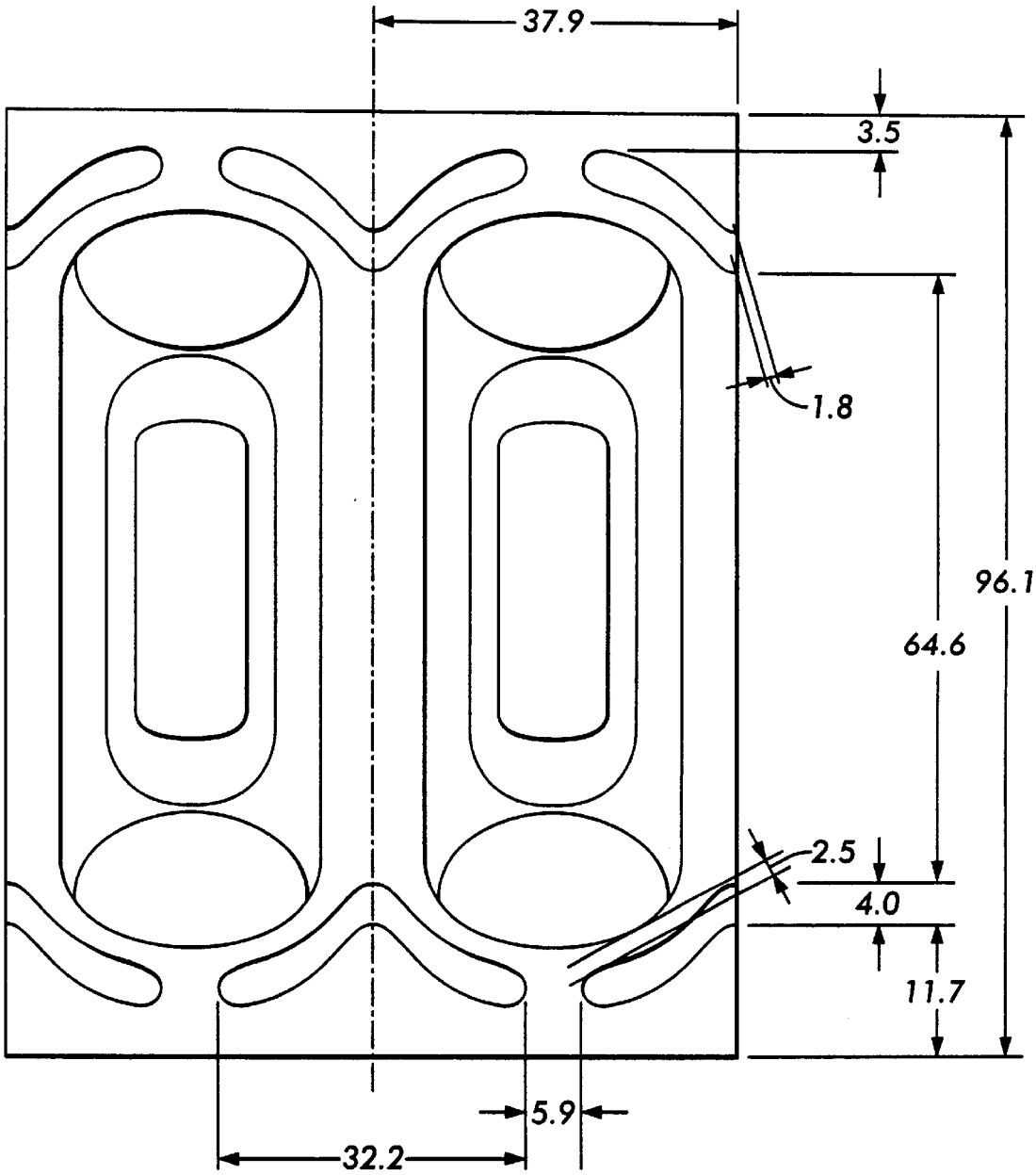
FIG. 4 is an enlarged view of the label portion of a container of the invention.
Figure 5:
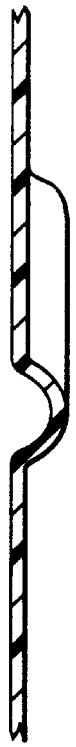
FIG. 5 is a cross-section depicting ribs directed radially outward.
Figure 6:
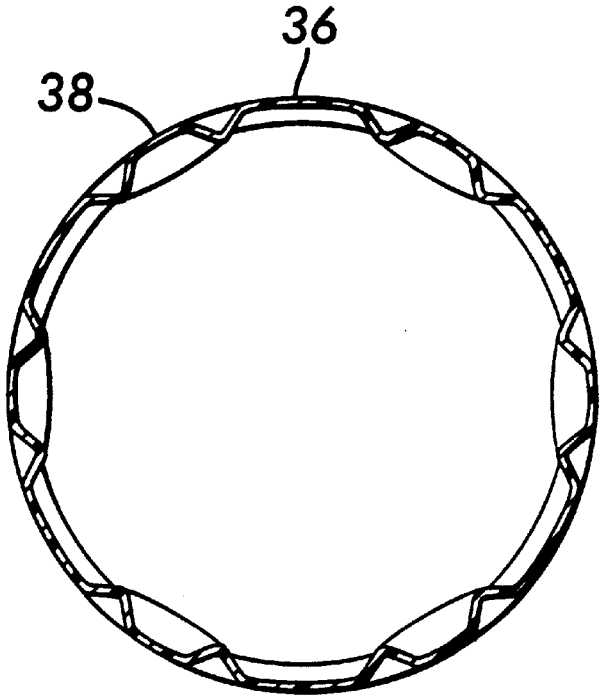
FIG. 6 depicts the respective elevations of the second land area, the first land area, and the elevation located in the intermediate panel portion.

For a twenty ounce plastic container having an outer diameter of approximately 72 mm and as depicted in FIG. 4, the vertical length of the label area is approximately 96 mm and the vertical length of the vacuum panels is approximately 75 mm.

As depicted in FIG. 4, the radius of the cross section of each of the arched ribs is about 1.8 mm. The depth of the cross section of each arched rib is approximately 1 mm. The length of each arched rib from end to end is about 32.2 mm. The width of an arched rib, i.e., the dimension of the rib from top edge to bottom edge, is approximately 4 mm.

As shown in FIG. 4, for the upper series of ribs, the end of each arched rib is spaced from the upper edge of the upper bumper area by a distance of about 3.5 mm. For the lower series of ribs, the end of each arched rib is spaced from the lower edge of the lower bumper area by a distance of about 3.5 mm. The distance from the peak of an arch to the edge of the adjacent bumper area is about 15.7 mm. The gap between the vacuum panels and the arched ribs is approximately 2.5 mm.

The center or peak of each arched rib is located about 38 mm from the center or peak of the adjacent arched rib. The distance between arched ribs, from the end of one to the end of the adjacent rib, (i.e., the length of land area (58)) is approximately 5.9 mm.

Of course, the curved ribs of the invention may take many different forms. For example, the curved ribs may be substantially round, horseshoe, lancet, ogee, trefoil, basket-handle, or Tudor shaped arches or the like. The radius of the point or center of the arch may also vary. For example, the radius may vary from greater than about 10 to less than about 100 mm, preferably between about 10 and 50 mm, even more preferably between about 10 to 30 mm.

The above is offered by way of example only, and the size of the reinforcement rib is a function of the size of the container, and would be increased from the values given in proportion to an increase in the dimensions of the container from the dimensions given for container (10).

In a preferred embodiment, the elevation of the land area (58) between the arched ribs is substantially similar to the elevation of the land area (36) between the vacuum panels and is also substantially similar to an elevation located in the intermediate panel portion (38). The elevations can be measured from any point extending from the longitudinal axis (40) of the container to the elevation being measured, as long as the measurement from the longitudinal axis is along a line that is perpendicular to a point of measurement on said elevation. This is to provide additional areas for receiving and adhering a label during the label application process.

Thus, the present invention provides a hot-fill bottle which has improved vacuum panels and reinforcement ribs that resist deformation. The novel structure of the hot fill bottle minimizes the stress points on the corners of the vacuum panels. This advantage is achieved by providing the container with a label mount area having vacuum panels with upper and lower edges that are substantially arched (as opposed to substantially straight) in combination with reinforcement ribs that are also substantially arched. The novel structure of the hot-fill container of the present invention provides the vacuum panels with additional resistance to flexing and deformation, thereby minimizing the likelihood of container failure during storage and use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A thin-walled, hot-fillable plastic container having a body portion, said body portion having a substantially circular cross-section wherein said body portion comprises a label mounting area extending between an upper label bumper and a lower label bumper, said label mounting area comprising:

a plurality of evenly spaced vacuum panels having upper and lower edges, substantially straight edges, and a panel portion intermediate said upper and lower edges, wherein said vacuum panels are separated by a first land area; and a plurality of arched ribs, said arched ribs having arches that span circumferentially around said body, said ribs extending noncontinuously around the circumference of said body, being spaced apart from each other by a second land area, and being spaced apart from said vacuum panels.

2. The plastic container of claim 1 wherein said upper and lower edges of said vacuum panels are substantially arched.

3. The plastic container of claim 1 wherein said ribs are positioned proximate to said first land area.

4. The plastic container of claim 1 wherein each rib is directed radially inward.

5. The plastic container of claim 1 wherein each rib is directed radially outward.

6. The plastic container of claim 1 wherein the contour of at least a portion of said rib is substantially similar to at least a portion of the contour of the adjacent vacuum panel.

7. The plastic container of claim 1 wherein said ribs are located in series below said first land area.

8. The plastic container of claim 1 wherein said ribs are located in series above said first land area.

9. The plastic container of claim 1 wherein said label mount area comprises an upper and lower series of ribs and wherein the contour of each series of ribs is substantially scalloped.

10. The plastic container of claim 1 wherein said ribs are substantially semi-circular in cross-section.

11. The plastic container of claim 1 wherein an elevation of said second land area between said ribs is substantially similar to an elevation of said first land area between said vacuum panels and to an elevation located in said intermediate panel portion, such that there is provided additional areas for receiving a label.

12. The plastic container of claim 1 further comprising a label extending around said container over said vacuum panels and secured to said container in said label mounting area.

13. The plastic container of claim 1 wherein at least a portion of said arches extends into said first land area.

14. A thin-walled, hot-fillable plastic container having a body portion, said body portion having a substantially circular cross-section wherein said body portion comprises a label mounting area extending between an upper label bumper and a lower label bumper, said label mounting area comprising:

a plurality of evenly spaced vacuum panels having substantially arched upper and lower edges, substantially straight side edges and a panel portion intermediate said upper and lower edges, wherein said vacuum panels are separated by a first land area; and a plurality of arched ribs, said arched ribs having arches that span circumferentially around said body, said ribs extending noncontinuously around the circumference of said body, being spaced apart from said vacuum panels, and proximate to a first land area.

15. The plastic container of claim 14 wherein each rib is directed radially inward.

16. The plastic container of claim 14 wherein each rib is directed radially outward.

17. The plastic container of claim 14 wherein the contour of at least a portion of said rib is substantially similar to at least a portion of the contour of the adjacent vacuum panel.

18. The plastic container of claim 14 wherein said ribs are located in series below said first land area.

19. The plastic container of claim 14 wherein said ribs are located in series above said first land area.

20. The plastic container of claim 14 wherein said label mount area comprises an upper and lower series of ribs and wherein the contour of each series of ribs is substantially scalloped.

* * * * *

UNITED STATES PATENT AND TRADEMARK OFFICE

CERTIFICATE OF CORRECTION

PATENT NO. : 6,347,717 B1
DATED : February 19, 2002
INVENTOR(S) : Theodore F. Eberle It is certified that error appears in the above-identified patent and that said Letters Patent is hereby corrected as shown below:

Column 1,
Line 64, delete “point” and insert -- points --;

Column 3,
Line 4, delete “invention.” and insert -- invention; --;
Line 6, delete “outward.” and insert -- outward; --;
Line 17, delete “terephthlate” and insert -- terephthalate --;
Line 41, delete “space-apart” and insert -- spaced-apart --;

Column 4,
Line 16, delete “identically” and insert -- identical --.

Signed and Sealed this

First Day of June, 2004

JON W. DUDAS
*Acting Director of the United States Patent and Trademark Office*